United States Patent [19]

Cinpinski

[11] Patent Number: 4,724,813

[45] Date of Patent: Feb. 16, 1988

[54] INTERNAL COMBUSTION ENGINE WITH DILUTION REDUCTION IN RESPONSE TO SURGE DETECTION

[75] Inventor: Kenneth J. Cinpinski, Sterling Heights, Mich.

[73] Assignee: General Motors Corporation, Detroit, Mich.

[21] Appl. No.: 24,290

[22] Filed: Mar. 10, 1987

[51] Int. Cl.[4] ..... F02D 41/26

[52] U.S. Cl. ..... 123/436; 364/431.08

[58] Field of Search ..... 123/419, 436, 435, 425; 364/431.05, 431.08

[56] References Cited

U.S. PATENT DOCUMENTS

| | | | |
|---|---|---|---|
| 3,789,816 | 2/1974 | Taplin | 123/436 |
| 4,197,767 | 4/1980 | Leung | 74/860 |
| 4,323,042 | 4/1982 | Woodhouse et al. | 123/436 |
| 4,337,647 | 7/1982 | Radcliffe et al. | 73/116 |
| 4,344,140 | 8/1982 | Leung | 364/431.08 |
| 4,380,800 | 4/1983 | Wilkinson | 364/431.08 |
| 4,509,484 | 4/1985 | Gertiser | 123/436 |
| 4,527,523 | 7/1985 | Däumer et al. | 123/436 X |
| 4,616,617 | 10/1986 | Geiger et al. | 123/436 |

FOREIGN PATENT DOCUMENTS

| | | | |
|---|---|---|---|
| 3415214 | 10/1985 | Fed. Rep. of Germany | 123/436 |
| 0056145 | 4/1985 | Japan | 123/436 |
| 0062661 | 4/1985 | Japan | 123/436 |

*Primary Examiner*—Willis R. Wolfe

*Attorney, Agent, or Firm*—Robert M. Sigler

[57] ABSTRACT

A control decreases dilution (EGR) in an internal combustion engine from a schedule if surge is detected and allows it to return to the schedule in the absence of surge. Surge is detected by timing a predetermined crank angle of 70–10 degrees BTDC, an angle including only crank deceleration, for consecutive engine firings, updating an average time therewith and computing the difference between the new time and the average. The successive differences are examined for zero crossings and compared to a stored maximum difference. If difference exceeds the maximum it becomes the new maximum difference. If a zero crossing is detected, the time since the last zero crossing is calculated to determine if the difference variations have a frequency of 2–10 Hz. If so, and the maximum difference exceeds a reference, a surge signal is generated.

2 Claims, 6 Drawing Figures

INTERNAL COMBUSTION ENGINE WITH DILUTION REDUCTION IN RESPONSE TO SURGE DETECTION

BACKGROUND OF THE INVENTION

This invention relates to dilution control of internal combustion engines subject to driveability problems associated with surge.

Surge is an engine roughness which is detectable by the vehicle operator and passengers and is associated with periodic engine rotational speed variations in a frequency range of substantially 2-10 Hz. The phenomenon is well known and has been described in the prior art.

There is a great deal of prior art showing engine roughness detectors, some of which deals particularly with the detection of surge as defined above. However, most of the prior art in this area dates from the era before the common use of microcomputers in engine control; and the roughness detectors shown are hard wired electronic circuits. With the advent of microcomputer engine control, these circuits and the processes embodied therein are no longer optimal.

SUMMARY OF THE INVENTION

The dilution control of this invention uses a surge sensing technique that is particularly well adapted to microcomputer control of an internal combustion engine. It may be added inexpensively to many existing microcomputer controls as a small additional block of program code with no new sensors or actuators. It also more accurately detects surge than most prior art apparatus or methods.

The dilution control of this invention detects the time duration of a constant predetermined crankshaft rotational angle during the period of crankshaft deceleration before top dead center (BTDC) for each consecutively ignited combustion chamber. By timing crankshaft rotation only during the specified crank angle during crankshaft deceleration for each fired combustion chamber, a great deal of extraneous "noise" information is suppressed, particularly a component at twice the firing frequency that otherwise would dominate the signal.

The dilution control of this invention uses each new detected time duration to update an average time duration and takes the difference between the new time duration and the average. For each new difference, it checks for a zero crossing and compares the difference to a stored maximum value. If the difference is greater than the stored maximum value, it is stored as the new maximum value. When a zero crossing is detected, a surge signal is generated if the time from a predetermined previous zero crossing to the new zero crossing corresponds to a frequency of substantially 2–10 Hz and the stored maximum exceeds a predetermined reference. A scheduled dilution control parameter is changed to decrease dilution if a surge signal is generated and allowed to return toward the scheduled value if it is not generated.

Further details and advantages of this invention will be apparent from the accompanying drawings and following description of a preferred embodiment.

SUMMARY OF THE DRAWINGS

FIG. 2(*c*) shows a curve of crankshaft rotational velocity over an engine cycle illustrating the predetermined crankshaft rotational angle over which the times plotted in FIGS. 2(*a*) and 2(*b*) are measured.

DESCRIPTION OF A PREFERRED EMBODIMENT

Figure 1:
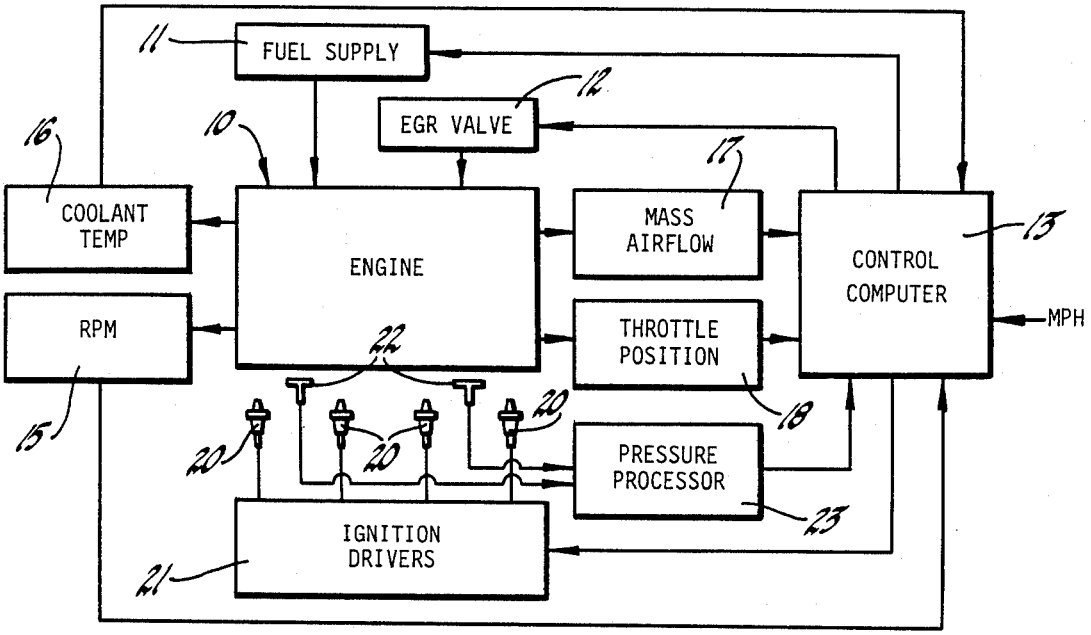
FIG. 1 shows a block diagram of an engine with a control according to this invention.

Referring to FIG. 1, an internal combustion engine 10 is of the standard type having a plurality of cylinders or combustion chambers. In this embodiment, there are four such cylinders, each provided with air and fuel through standard fuel supply apparatus 11. Fuel supply apparatus 11 comprises normal air intake apparatus including air cleaner, intake manifold, throttle valve and intake valves, and normal fuel injection apparatus including fuel injectors and injector drivers which are activated in response to timed, sequential signals from a control computer 13. The air and fuel forms a combustible fuel charge within the combustion chamber which has a composition controlled in the normal manner through the duration of the injector pulses relative to the mass of air in the cylinder and by dilution control apparatus. The air/fuel ratio control may be stoichiometric in response to a standard oxygen sensor in the exhaust system of engine 10.

The dilution control apparatus may include an exhaust gas recirculation (EGR) valve 12 to control the rate of inert exhaust gases fed back to the air supply apparatus. The degree of opening of EGR valve 12 is controlled through a range from closed to maximum open by a stepper motor or equivalent means for accurate control of EGR flow, the stepper motor receiving positioning signals from computer 13. Other forms of dilution control apparatus may be used, either alternatively or in addition. For example, a variable lift adjusting device for the intake valves of engine 10 is described in U.S. Ser. No. 834,791, Variable Valve Lift/Timing Mechanism, filed Feb. 28, 1986 by Duane J. Bonvallet issued on Jan. 27, 1987 as U.S. Pat. No. 4,638,773. This device, actuated by a stepper motor or other actuator means, will also be effective to control the dilution of the fuel charge within the associated combustion chamber.

Control computer 13 may be a standard digital microcomputer having a microprocessor, RAM, ROM, input/output apparatus and a clock and typified by a microcomputer of the Motorola (R) 6800 series. It includes, in ROM, a stored program for controlling fuel supply system 11, EGR valve 12 and an ignition system, to be described below, in response to values of engine operating parameters from a plurality of sensors. An engine speed (RPM) sensor 15 may be based on a 180 tooth wheel turning with the engine harmonic balancer and a magnetic or other pickup to generate electrical pulses as it is passed by teeth of the rotating wheel. Control computer 13 or other dedicated apparatus may measure the time between consecutive RPM pulses and generate an engine speed signal therefrom. In addition, the counting of the RPM pulses can be used along with absolute crankshaft reference pulses from the standard distributor, not shown, of engine 10 to indicate absolute crankshaft rotational position at any time. If the arcs of the teeth and the spaces between the teeth are equal, a pulse can be generated every degree of crankshaft rotation. A coolant temperature sensor 16 of the normal type supplies a coolant temperature signal to computer 13. A mass airflow sensor 17 generates a signal of the mass air flow rate to the cylinders; and throttle position sensor 18 generates a throttle position signal, both said signals being provided to computer 13. Throttle position sensor 18 and coolant temperature sensor 16 are useful for controlling entry of the system into power enrichment and start/warmup operating modes, respectively.

Each cylinder of engine 10 is provided with a spark plug 20 effective, when fired, to initiate combustion of the combustible charge within the combustion chamber. Spark plugs 20 are fired by ignition drivers 21 in response to signals from computer 13. Spark plugs 20 and ignition drivers 21 may be of any standard type, with ignition drivers 21 responsive to firing pulses to fire spark plugs 20 and further effective to control the ignition dwell time.

Computer 13 includes means, such as stored tables, for storing or determining predetermined schedules for fuel injection pulse width (combustion mixture air/fuel ratio), ignition timing and dilution (EGR). Such tables may use input lookup parameters based on engine speed and load and may be subject to modification or trim by other sensed engine operating parameters. For example, combustion pressure sensors 22 may be provided to sense the pressure within the cylinders of engine 10 and generate a signal thereof. A pressure signal processor 23 may be provided to detect timing and/or amplitude of peak combustion pressure for use by computer 13 in determining any or all of the predetermined fuel, ignition or EGR schedules.

Figure 2:
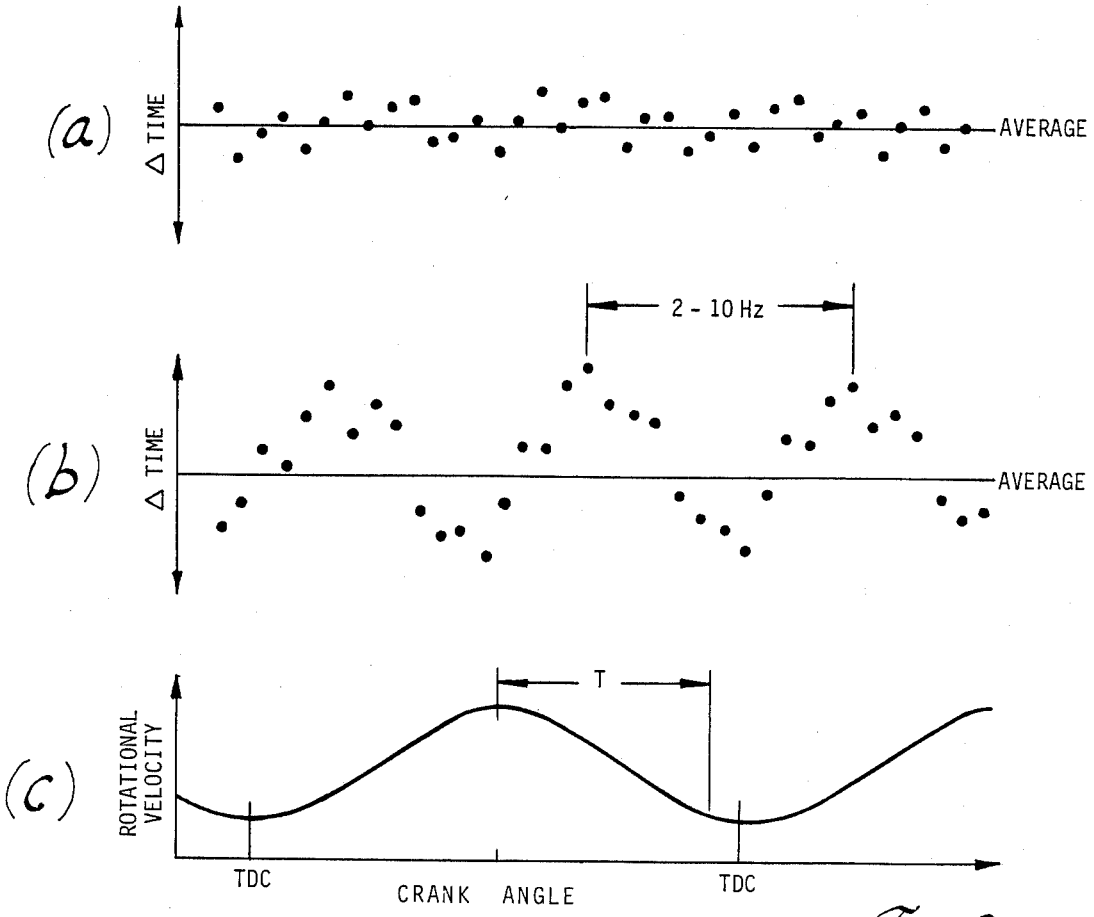
FIGS. 2(*a*) and 2(*b*) show plots of the times of individual consecutive crankshaft rotations through a predetermined crank angle for the engine of FIG. 1 compared to the average of such times for the cases of no surge and surge.

The phenomenon of surge can be illustrated with reference to FIGS. 2(*a*)–2(*c*). If the time of crankshaft rotation through a crank angle of 70 to 10 degrees before top dead center (BTDC), as shown by crank angle T in FIG. 2(*c*), is measured for consecutive engine firings, the result with no surge is similar to the plot of FIG. 2(*a*). Although the individual times deviate from the average, no perceptible pattern is clear. However, under some engine operating conditions of marginal combustion, the small deviations are superimposed on a larger pulsation of 2–10 Hz. This pattern is called surge. It should be made clear at this point, however, that the well known phenomenon of surge is not defined in the prior art in the terms of this paragraph or FIGS. 2(*a*)–2(*c*). Nowhere in the prior art, to my knowledge, does it state that surge is most detectable by examining the time for traversing the crank angle from 70 to 10 degrees BTDC. However, the lower noise that enables my invention to work in a superior manner also facilitate clarity in demonstrating the phenomenon.

In order to detect surge, the normal RPM routine of computer 13 is modified slightly. As it detects the passage of teeth in the rotating toothed wheel of the RPM sensor 15, it normally reads the time of each tooth edge passing from a real time clock and calculates the time duration from the last tooth edge as well as counting tooth edges to monitor crankshaft rotational position. However, in addition, computer 13 stores the time of the tooth edge at 70 degrees BTDC and, when the tooth edge at 10 degrees BTDC is detected, stores its time and calls a surge subroutine as shown in flowchart form in FIG. 3.

Figure 3:
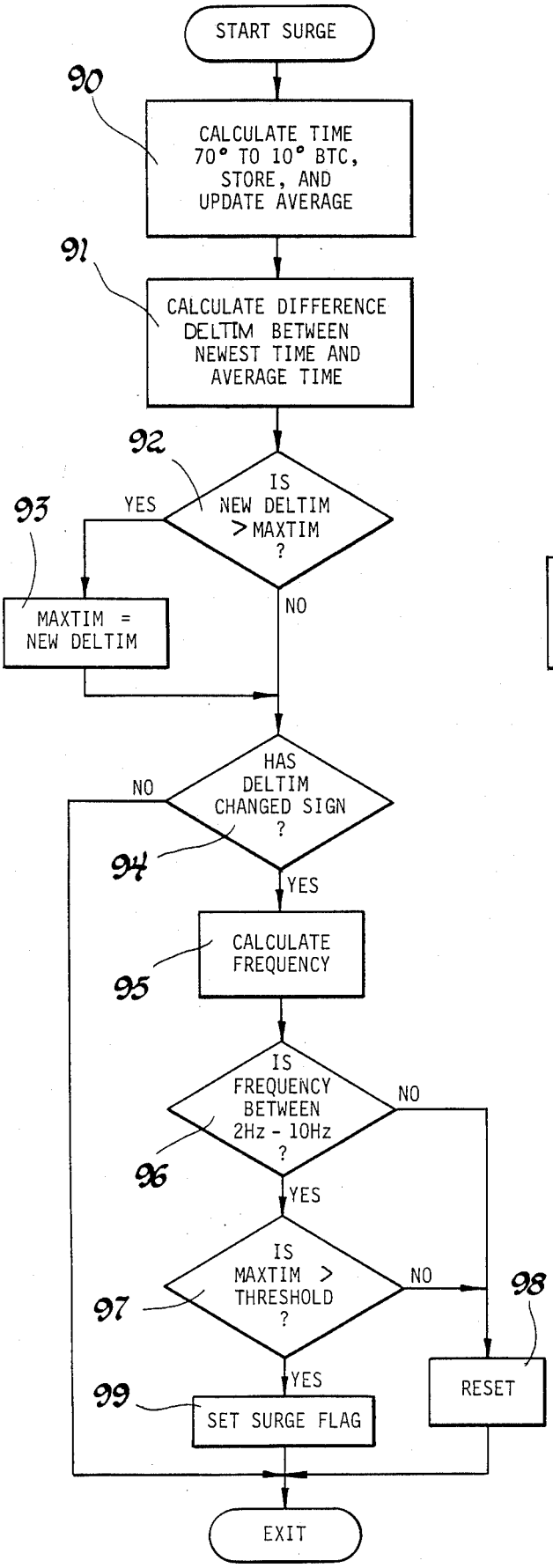
FIGS. 3 and 4 show flow charts describing the operation of the control of this invention with the engine of FIG. 1.

Referring to step 90 of FIG. 3, the apparatus calculates, from the stored times of the passage of 70 and 10 degrees BTDC, the time duration for the passage of that 60 degree crankshaft angle, stores that time and updates a running average of consecutive such times. At step 91, the difference DELTIM between the most recent time and the average time is calculated. If, at decision point 92, DELTIM is greater than a value MAXTIM, it replaces MAXTIM in memory at step 93. Otherwise, step 93 is skipped. Thus, MAXTIM will increase with DELTIM and remain at the maximum value as DELTIM decreases. If DELTIM has changed sign from the last calculated DELTIM value at decision point 94, the apparatus proceeds to step 95; otherwise it exits the surge subroutine. Thus, the half cycle points of DELTIM are detected.

At step 95, the frequency of DELTIM is calculated, by taking the difference between the latest stored 10 degree BTDC time and the similar time stored in memory at this step the last time it was reached in the subroutine. This frequency may also be calculated over a larger number of half cycles or averaged if desired. The new stored 10 degree BTDC time is then stored for use in this step the next time it is encountered.

If the frequency is found to be within the surge range of 2–10 Hz at decision point 96 and to be of sufficient amplitude, as determined by the value of MAXTIM, at decision point 97, then the surge flag is set at step 99 before the apparatus exits the subroutine. If either of these conditions is not met, then the surge flag is reset, MAXTIM is reset to zero, and the subroutine is exited.

Figure 4:
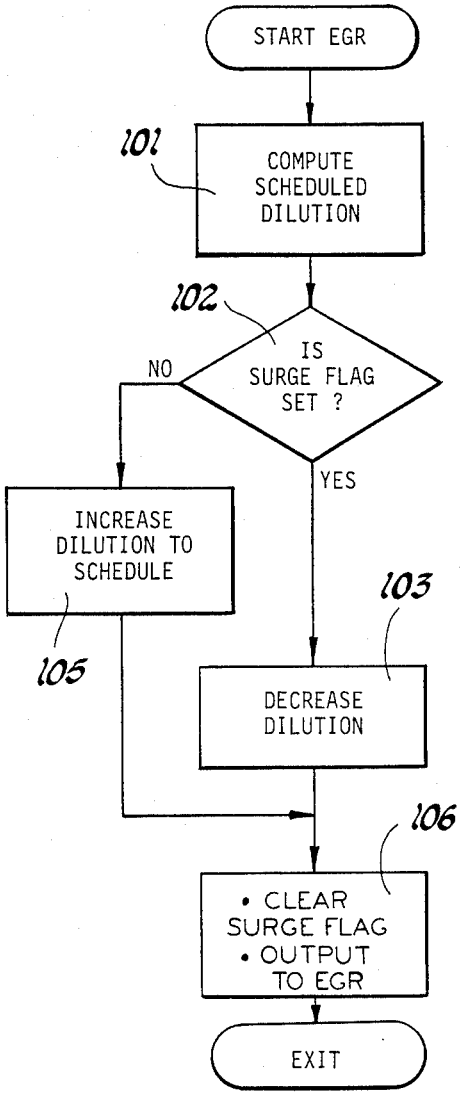

Referring to the flow chart of FIG. 4, computer 13 computes a scheduled dilution value at step 101 in any known manner and then checks the surge flag at decision point 102. If the surge flag is set, computer 13 modifies the normally scheduled dilution value at step 103 to decrease the dilution level. The rate and overall limit of dilution decrease are matters for the engine calibration process and possible modification by sensed engine parameters. If the surge flag is not set, dilution is increased at step 105 back toward the scheduled value if it has been decreased therefrom. Once again, the rate of increase is a matter for calibration with possible modification in response to sensed engine parameters. Finally, at step 106, computer 13 clears the surge flag and outputs the dilution value to the EGR valve 12 or equivalent apparatus as previously discussed.

The embodiments of the invention in which an exclusive property or privilege is claimed are defined as follows:

1. A dilution control for an internal combustion engine having a plurality of combustion chambers in which fuel charges are ignited in a predetermined order, a rotating crankshaft and a dilution control mechanism controllable to vary the dilution gas content of the fuel charge according to a predetermined schedule, comprising in combination:

first means effective to detect the time duration of a constant predetermined crankshaft rotational angle during the period of crankshaft deceleration before top dead center (BTDC) for each consecutively ignited combustion chamber;

second means effective to update an average time duration with selected periodic time durations detected by the first means;

third means effective to compute the difference between selected periodic time durations detected by the first means and the average time duration;

fourth means effective to detect zero crossings of successive differences as computed by the third means and derive therefrom the period and therefore the frequency of said zero crossings;

fifth means effective to compute and store each new maximum value of the difference as computed by the third means between zero crossings as detected by the fourth means and thereby detect the maximum value of the differences between said zero crossings;

sixth means effective, for selected periodic zero crossings, to generate a surge signal if the period of said zero crossing as derived by the fourth means corresponds to a predetermined frequency range of substantially 2 to 10 Hz and if the maximum difference as detected by the fifth means is greater than a predetermined reference; and seventh means effective to decrease dilution from the predetermined schedule in response to said surge signal and allow dilution to return to the predetermined schedule in the absence of the surge signal.

2. The dilution control of claim 1 in which the constant predetermined crankshaft rotational angle of the first means is substantially from 70 to 10 degrees BTDC.

* * * * *